US011865468B2

(12) United States Patent
Catz et al.

(10) Patent No.: US 11,865,468 B2
(45) Date of Patent: Jan. 9, 2024

(54) ACTIVITY BOX

(71) Applicant: Lovevery, Inc., Boise, ID (US)

(72) Inventors: Israel David Catz, Boise, ID (US); Jessica Thacher Crolick Rolph, Boise, ID (US); Claire Way-June Liu, San Francisco, CA (US); Thomas Creason Rigby, Boise, ID (US); Philip Jacob Fouts, Boise, ID (US)

(73) Assignee: Lovevery, Inc., Boise, ID (US)

( * ) Notice: Subject to any disclaimer, the term of this patent is extended or adjusted under 35 U.S.C. 154(b) by 0 days.

(21) Appl. No.: 17/675,956

(22) Filed: Feb. 18, 2022

(65) Prior Publication Data

US 2022/0168659 A1 Jun. 2, 2022

Related U.S. Application Data

(62) Division of application No. 17/671,151, filed on Feb. 14, 2022, now abandoned, which is a division of (Continued)

(51) Int. Cl.
*A63H 17/26* (2006.01)
*A63H 33/00* (2006.01)
(Continued)

(52) U.S. Cl.
CPC ..... *A63H 17/262* (2013.01); *A63H 33/003* (2013.01); *A63H 33/046* (2013.01); *B65D 5/5033* (2013.01)

(58) Field of Classification Search
CPC ..... B65D 81/056; B65D 2581/055; B65D 51/053; B65D 5/5033; B65D 51/054;
(Continued)

(56) References Cited

U.S. PATENT DOCUMENTS 288,662 A 11/1883 Reed
741,903 A 10/1903 Gates
(Continued)

FOREIGN PATENT DOCUMENTS

GB 2002244 2/1979
WO WO 1997/26063 7/1997

OTHER PUBLICATIONS

International Preliminary Report on Patentability in International Appln. No. PCT/US2020/55614, dated Apr. 28, 2022, 10 pages.
(Continued)

*Primary Examiner* — King M Chu
*Assistant Examiner* — Prince Pal
(74) *Attorney, Agent, or Firm* — Fish & Richardson P.C.

(57) ABSTRACT

An activity box includes two pairs of wheels having blind holes, two axles having two ends releasably insertable into the blind holes, and a box defining a space having a defined volume sufficiently large to fit the axles. The wheels include a first magnetically attractable component. The axles include a second magnetically attractable component secured at each end of each axle. The axles have a length spanning a width of the box, which has two pairs of through holes on two opposing sides to accommodate the axles, such that the axles are threaded through the through holes. The two pairs of wheels are rotatably attached to the box by magnetically coupling the first magnetically attractable component to the second magnetically attractable component, such that the activity box is configured to be used as a cart that can be rolled over a surface.

20 Claims, 10 Drawing Sheets

Related U.S. Application Data application No. 16/653,035, filed on Oct. 15, 2019, now Pat. No. 11,247,139.

(51) Int. Cl.
*A63H 33/04* (2006.01)
*B65D 5/50* (2006.01)

(58) Field of Classification Search
CPC .. B65D 51/107; A63H 17/262; A63H 33/003; A63H 33/046
USPC ..... 206/503, 509, 511, 512, 486, 586, 453, 206/521, 523, 451, 350, 499
See application file for complete search history.

(56) References Cited

U.S. PATENT DOCUMENTS 1,192,530 A 7/1916 Kirk
1,572,141 A 2/1926 Hildebrandt
1,848,598 A 3/1932 Barnes
1,932,368 A 10/1933 Bowman
2,623,303 A 12/1952 Mindel
2,659,163 A 11/1953 Wilder
2,770,915 A 11/1956 Hicks
2,825,178 A 3/1958 Hawkins
2,911,740 A 11/1959 Miller
3,091,888 A 6/1963 Patch
3,261,619 A 7/1966 Norgaard
3,375,604 A 4/1968 Alonso
3,410,021 A 11/1968 Patterson
3,474,563 A 10/1969 Boster
3,510,964 A 5/1970 Dahners et al.
3,629,970 A 12/1971 Baynes
3,701,465 A * 10/1972 Richter ..... B65D 81/056 206/521
3,827,695 A 8/1974 Hess
4,149,717 A 4/1979 Seijiro
4,286,952 A 9/1981 Roche
4,295,293 A 10/1981 Baclit
4,323,238 A 4/1982 Jernstrom et al.
4,353,701 A 10/1982 Greenberg
4,403,441 A 9/1983 White
4,422,850 A 12/1983 Groebner
4,455,781 A 6/1984 Blumenthal
4,464,125 A 8/1984 Lierl
4,508,512 A 4/1985 Girsch et al.
4,963,115 A 10/1990 Stowell
4,988,083 A * 1/1991 Bradley ..... B65D 81/056 267/140
4,992,068 A 2/1991 Conrad
5,139,453 A 8/1992 Aiken et al.
5,314,338 A 5/1994 Caveza et al.
5,380,232 A 1/1995 Berggreen
5,474,483 A 12/1995 Sun
5,531,326 A * 7/1996 Hummel ..... B65D 5/006 220/640
5,752,701 A 5/1998 Kao
6,274,217 B1 * 8/2001 Kim ..... B65D 5/509 428/218
6,368,694 B1 * 4/2002 Marsh ..... B65D 81/055 229/199
7,238,026 B2 7/2007 Brown et al.
7,422,112 B1 * 9/2008 Harte ..... B65D 81/09 206/583
8,157,094 B2 4/2012 Schiessl
2003/0038423 A1 2/2003 Turner et al.
2004/0206650 A1 * 10/2004 Kettler ..... B65D 81/056 206/386
2009/0209166 A1 8/2009 Chen
2010/0155291 A1 * 6/2010 Dunn ..... B65D 81/107 206/524
2011/0108498 A1 * 5/2011 Haeberlein ..... H02S 20/23 211/41.1
2011/0186458 A1 8/2011 Schiessl
2013/0220845 A1 * 8/2013 Smith ..... A24F 25/02 206/213.1
2016/0197638 A1 * 7/2016 Demnard ..... A45C 11/38 455/575.8
2016/0214768 A1 7/2016 Landry
2016/0340102 A1 * 11/2016 Barnitz ..... B65D 63/10
2020/0172315 A1 * 6/2020 Hu ..... B65D 81/113
2020/0198867 A1 * 6/2020 Nakamichi ..... H01L 21/67369
2022/0009692 A1 * 1/2022 Takeshita ..... B65D 81/056
2022/0324625 A1 * 10/2022 Bowen ..... D21H 27/10

OTHER PUBLICATIONS

Extended European Search Report in European Appln No. 20875761.7, dated Oct. 24, 2022, 8 pages.

* cited by examiner

ACTIVITY BOX

CROSS-REFERENCE TO RELATED APPLICATIONS

This application is a divisional application of and claims the benefit of priority to U.S. application Ser. No. 17/671,151, filed on Feb. 14, 2022, which is a divisional application of and claims the benefit of priority to U.S. application Ser. No. 16/653,035, filed on Oct. 15, 2019, now U.S. Pat. No. 11,247,139. The entire contents of the foregoing are hereby incorporated by reference.

TECHNICAL FIELD

This invention generally relates to toys, and more particularly to activity boxes.

BACKGROUND

Children can develop spatial, language, cognitive, and problem-solving skills by playing with toys such as toy building blocks. It is desirable that such toys be safe and easy to use.

SUMMARY

One aspect of the present invention features an activity box including activity box, including two pairs of wheels having blind holes, the wheels comprising a first magnetically attractable component; two axles having two ends releasably insertable into the blind holes, the axles comprising a second magnetically attractable component secured at each end of each axle; and a box defining a space having a defined volume sufficiently large to fit the axles, the axles having a length spanning a width of the box, the box having two pairs of through holes on two opposing sides of the box to accommodate the axles, such that the axles are threaded through the through holes, wherein the two pairs of wheels are rotatably attached to the box by magnetically coupling the first magnetically attractable component to the second magnetically attractable component, such that the activity box is configured to be used as a cart that can be rolled over a surface.

In some embodiments, the side of the box defines an orifice. In some examples, the activity box further includes a string configured to be threaded through and secured to the orifice. In some cases, the activity box further includes a toggle string comprising a dowel, wherein the toggle string is configured to be threaded through the orifice. In some embodiments, the activity box further includes a magnetic lid having five different apertures, each aperture shaped to fit a component therethrough.

In some arrangements, the dowel has a length greater than the diameter of the orifice. In some embodiments, a side of the box defines a slot. In some embodiments, the first magnetically attractable component is embedded within the wheels at a base of each blind hole. In some examples, the first magnetically attractable component is a magnet. In some cases, the second magnetically attractable component is an overmolded insert. In some arrangements, the overmolded insert is an overmolded steel insert.

Another aspect of the present invention features an activity box, including a corner protector having: a rigid plastic core having a pair of walls integrally connected and forming a first right angle therebetween and a plate extending perpendicularly from an interior surface of the pair of walls, the plate having a threaded rod extending from a top surface of the plate; and a shock-absorbing exterior surface molded over the rigid plastic core; a box having two adjacent sides forming a second right angle at a corner recess configured to receive the corner protector; and a wooden brace attaching to the two adjacent sides at the corner recess, the wooden brace defining a hole configured to receive the threaded rod, wherein the corner protector provides impact resistance for the activity box.

In some embodiments, the shock-absorbing exterior surface is made out of a flexible or pliable material. In some examples, the flexible or pliable material is rubber, silicone, or polyurethane. In some arrangements, the wooden brace provides support to a load or strengthens the second right angle.

Another aspect of the present invention features an activity box, including: a removable panel; a plurality of components designed to cooperate with each other in order to form a rectangular shape having dimensions sufficiently large enough to occupy about one third of a volume of the activity box; a magnetic lid having a rim with four magnetic elements embedded therein, the magnetic lid having five different apertures, each aperture shaped to fit a component therethrough, wherein each component is shaped to fit through only one of the five different apertures.

In some embodiments, the component is shape sorter block. In some embodiments, the removable panel has an opening to facilitate removal of the panel. In some arrangements, the plurality of components has a three-dimensional, geometric shape. In some examples, the three-dimensional, geometric shape comprises a sphere, a cube, a cuboid, a cylinder, a triangular pyramid, a square pyramid, a plank, a torus, a triangular prism, a pentagonal prism, a trapezoidal prism, an arch, or any combination thereof. In some cases, the plurality of components comprises a dowel, a string, a toggle string, or any combination thereof. In some embodiments, the plurality of components comprises a first magnetically attractable element and a second magnetically attractable element, wherein the first magnetically attractable element is configured to magnetically couple to the second magnetically attractable element.

Various embodiments of the present disclosure relate to activity boxes including a plurality of components, some including magnetic elements, a lid, and a removable panel that can provide a child with numerous, different activities (e.g., at least 20 activities or more) to do. Such activities can increase in complexity and consequently, be suitable for a wide range of ages of children (e.g., between 12 months and 48 months of age). Furthermore, the activity boxes described herein include a plurality of components that can fit neatly into a box for compact storage. In addition, the activity boxes described herein are safe and made of non-toxic materials that can be easily wiped clean with a damp cloth.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
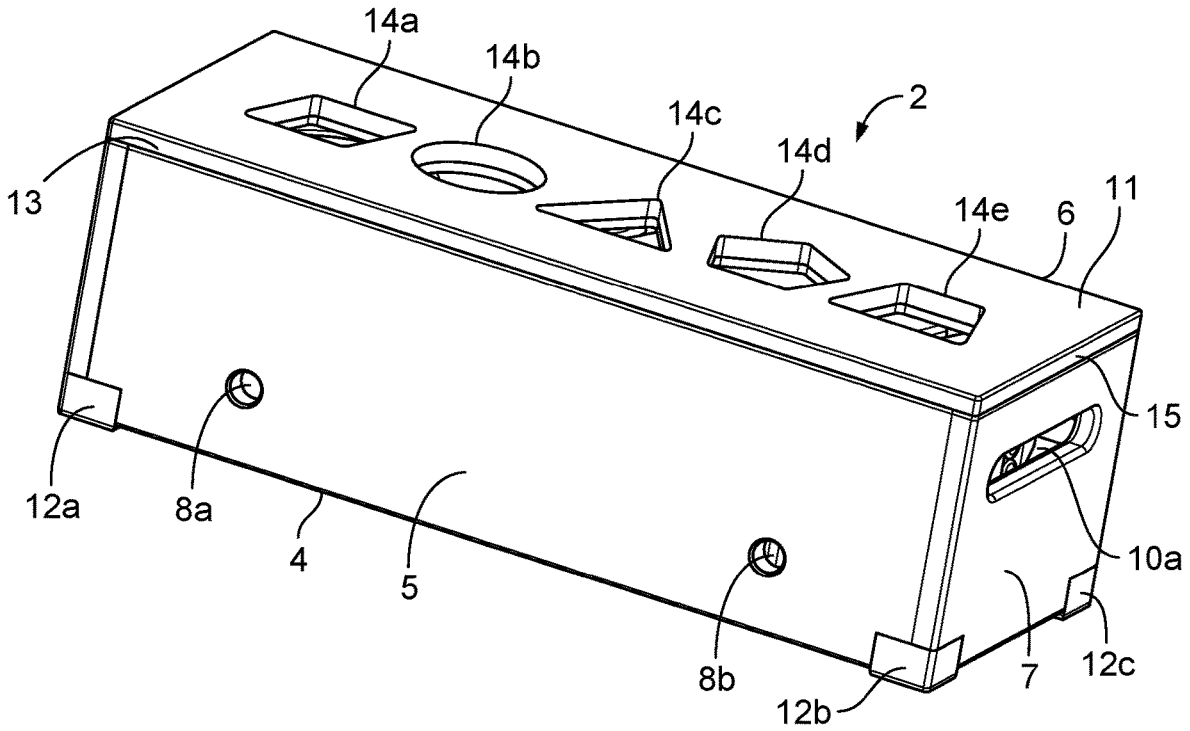
FIG. 1 is a perspective view of an activity box.

FIG. 1 shows a perspective view of an activity box 2. Activity box 2 includes a box 4 and a lid 6. Box 4 has a pair of side walls 5, a pair of end walls 7, an open top 9 (shown in FIG. 2), and a bottom surface 40 (shown in FIG. 6B). In this example, box 4 is rectangular in shape; however, box 4 can be, for example, a square or any other suitable geometric-shaped container. Box 4 and lid 6 are made out of non-toxic materials (e.g., wood) and can be coated with water-based, non-toxic coatings. In some embodiments, the activity box 2 is made out of a plastic material. Lid 6 is also rectangular in shape and has a top side 11, a bottom side, a pair of side edges 13, and a pair of end edges 15. Lid 6 defines a first aperture 14*a*, a second aperture 14*b*, a third aperture 14*c*, a fourth aperture 14*d*, and a fifth aperture 14*e*. Lid 6 is a shape sorter lid having each aperture shaped to fit a component therethrough. The apertures can have any suitable geometric or non-geometric shapes. In the example shown in FIG. 1, the first aperture 14*a* has a square shape, the second aperture 14*b* has a circular shape, the third aperture 14*c* has a triangular shape, the fourth aperture 14*d* has a pentagonal shape, and the fifth aperture 14*e* has a trapezoidal shape. Side walls 5 define a first through hole 8*a*, a second through hole 8*b*, a third through hole 8*c*, and a fourth through hole 8*d*. The first through hole 8*a* and second through hole 8*b* are defined by one side wall and are positioned closer to a bottom edge of box 4 than to a top edge of box. Similarly, the third through hole 8*c* and fourth through hole 8*d* are defined by the other side wall of box 4 and positioned such that they align with the first through hole 8*a* and second through hole 8*b*. End walls 7 define a first slot 10*a* and a second slot 10*b* that can be used as handles to grab the activity box 2. Box 4 further includes a first corner protector 12*a*, a second corner protector 12*b*, a third corner protector 12*c*, and a fourth corner protector 12*d*.

Figure 2:
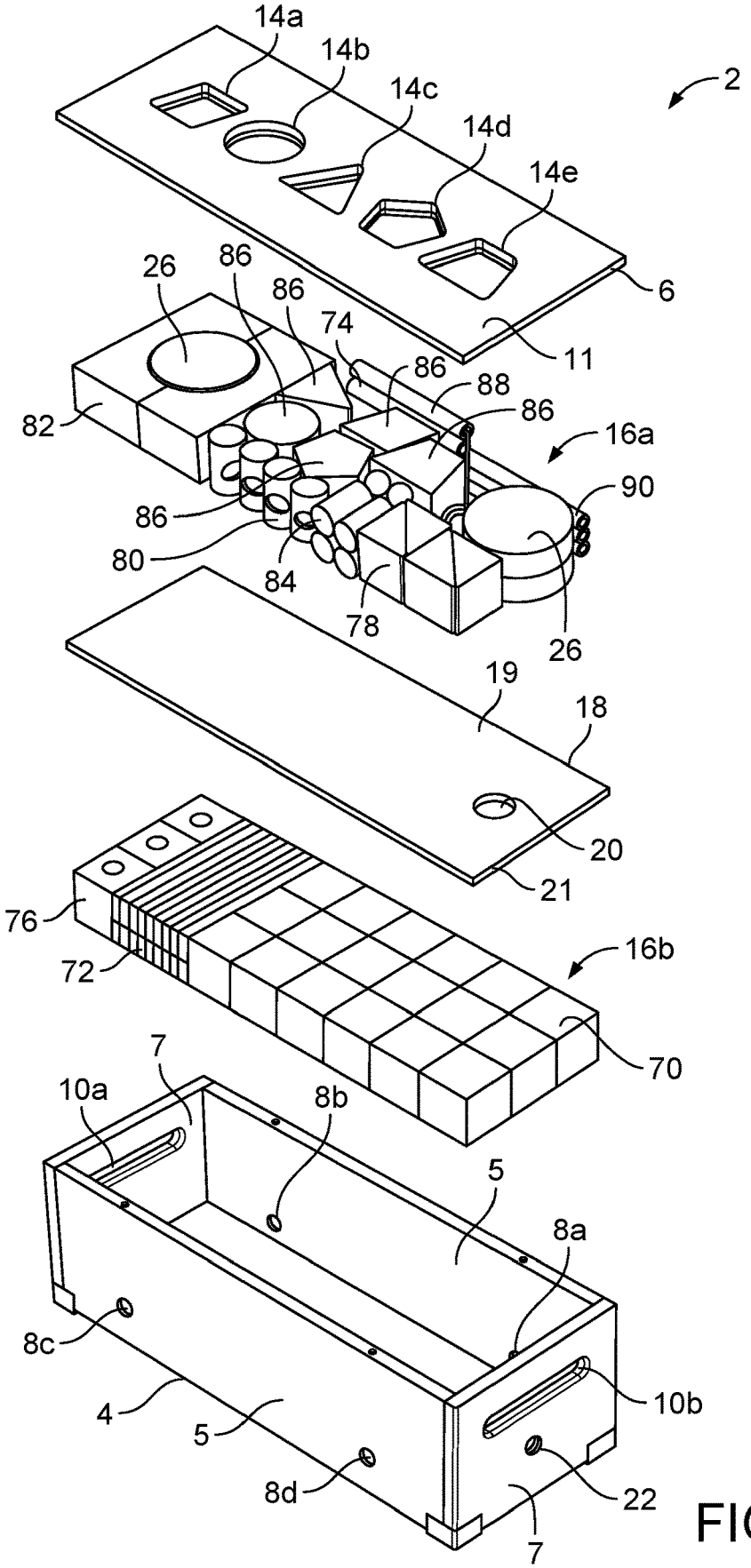
FIG. 2 is an exploded, perspective view of the activity box.

Referring to FIG. 2, activity box 2 includes a first plurality of components 16*a* and a second plurality of components 16*b*. The exploded view shown in FIG. 2 illustrates the order in which the lid 6, first plurality of components 16*a*, removable panel 18, second plurality of components 16*b*, and box 4 are arranged and nested during storage. Activity box 2 further includes a bag for receiving the first and second plurality of components 16*a* and 16*b* in case the user chooses not to nest all of the components for storage. Each one of the plurality of components 16*a* and 16*b* is designed to cooperate with each other in order to form a rectangular shape, as shown in FIG. 2. Each one of the plurality of components 16*a* and 16*b* has dimensions sufficiently large enough to occupy about one third of a volume of box 4, when the components are arranged to cooperate with each other. In some examples, when both the first and second pluralities of components 16*a* and 16*b* are arranged such that each one of the components are arranged to cooperate with each other, the first and second plurality of components has dimensions sufficiently large enough to occupy about two thirds of a volume of box 4. In some embodiments, when both the first and second pluralities of components 16*a* and 16*b* are arranged such that each one of the components are arranged to cooperate with each other, the first and second plurality of components has dimensions sufficiently large enough to occupy about half, about three quarters, or about seven eighths of a volume of box 4.

The first and second pluralities of components 16*a* and 16*b* have a three-dimensional, geometric shape. The three-dimensional, geometric shapes include a sphere, a cube, a cuboid, a cylinder, a triangular pyramid, a square pyramid, a plank, a torus, a triangular prism, a pentagonal prism, a trapezoidal prism, an arch, or any combination thereof. For example, as shown in FIG. 2, activity box 2 includes a set of eighteen building blocks 70 that can be arranged in a 6×3 array. Activity box 2 further includes the following components: 18 building planks 72, three threading blocks 76, four right triangles 78, four threading beads 80, two arches 82, four figurines 84, five shape sorter blocks 86, four wheels 26, a threader string 88, and two dowels 90. In some examples, each shape sorter block 86 is shaped to fit through only one of the five different apertures 14*a*, 14*b*, 14*c*, 14*d*, and 14*e* of lid 6. The first and second pluralities of components 16*a* and 16*b* can include components that further include a first magnetically attractable element and a second magnetically attractable element. The first magnetically attractable element can be configured to magnetically couple to the second magnetically attractable element. In some embodiments, the magnetically coupleable components can be magnetically coupled to adopt a defined arrangement that is suitable for storage in the box 4.

Activity box 2 includes a removable panel 18 that defines an opening 20. Removable panel 18 can be used to divide the first plurality of components 16*a* from the second plurality of components 16*b* when stored in box 4. Thus, when in use, the removable panel 18 is positioned on top of the second plurality of components 16*b* being stored inside box 4 and the first plurality of components 16*a* is stored on a top surface 19 of the removable panel 18. Alternatively, in some embodiments, the removable panel 18 can be positioned under the second plurality of components 16*b* or on top of the first plurality of components 16*a* during storage in box 4. The opening 20 is defined near an end edge 21 of the removable panel. In some embodiments, opening 20 can be defined near the end edge opposite of end edge 21, near the center of the removable panel, or in any suitable portion of the removable panel 18. Opening 20 facilitates removal of the removable panel 18 from storage by a user. In some embodiments, the removable panel 18 can define two, three, four, five, or more openings that facilitate removal. Opening 20 has a circular shape; however, opening 20 can have any other suitable geometric or non-geometric shape.

Figure 3A:
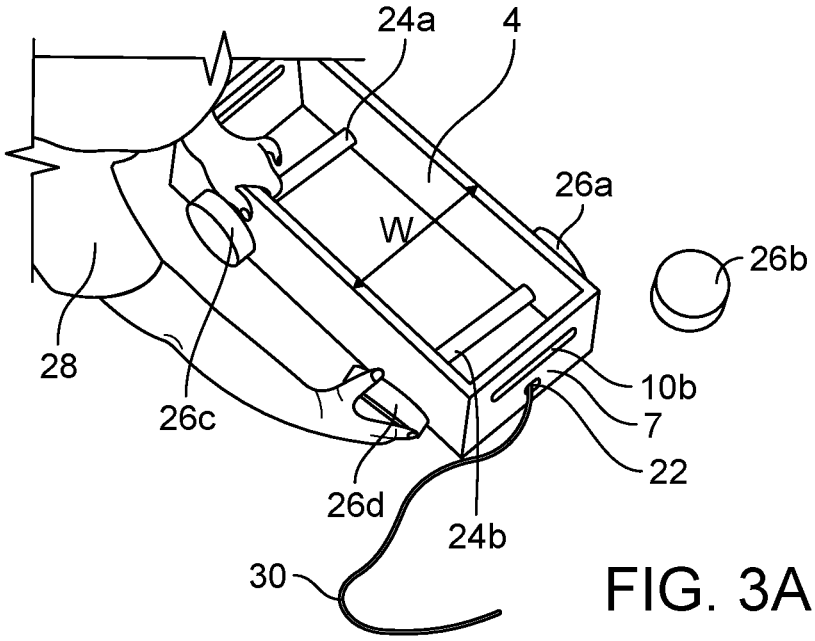
FIG. 3A is a top view of the activity box when configured to be used as a cart.
Figure 3B:
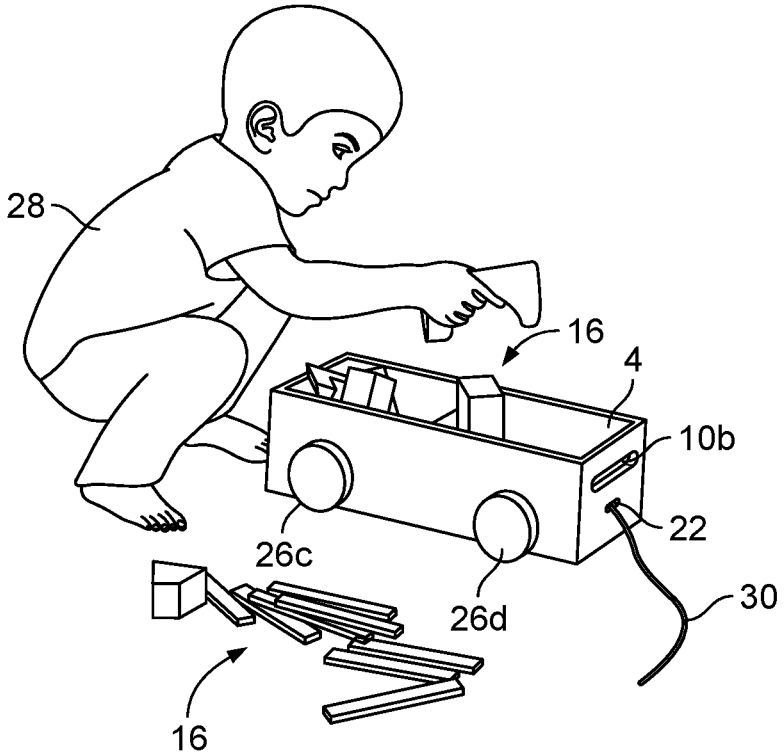
FIG. 3B is a side, perspective view of the activity box of FIG. 3A.

Box 4 further includes an orifice 22 defined by end wall 7. End wall 7 further defines the second slot 10*b*, as shown in FIG. 2. Activity box 2 can further include a string 30 which can be threaded through or secured to the orifice 22, as shown in FIGS. 3A and 3B. The string 30 can be used to pull the activity box 2 when configured to be used as a cart that can be rolled over a surface. String 30 can be a toggle string 74. In some examples, toggle string 74 can be a string secured to a dowel. The dowel can have a length that is greater than the diameter of orifice 22. In this manner, when the string is threaded through orifice 22 and pulled by a user (e.g., a child 28) the dowel abuts an interior surface of end wall 7 without exiting orifice 22 and enables the activity box 2 to be moved in the direction of the pulling force. In some embodiments, the dowel is a rod or a flat piece of wood or plastic. In some examples, the dowel has a rectangular or cylindrical shape.

Figure 4A:
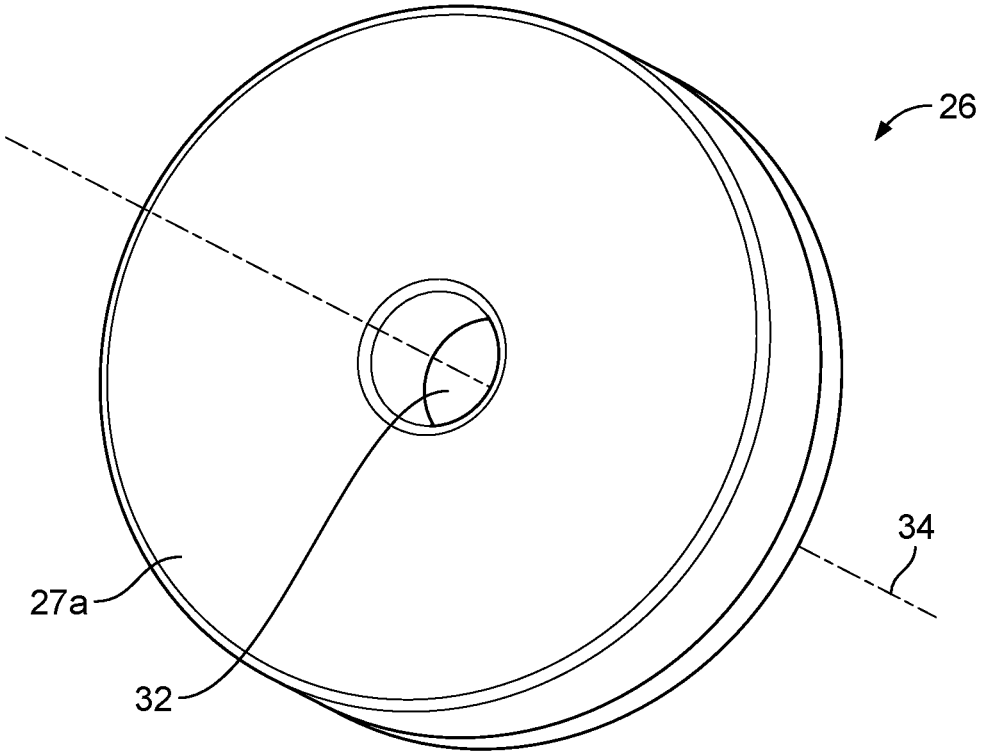
FIG. 4A is a perspective view of a wheel.
Figure 4B:
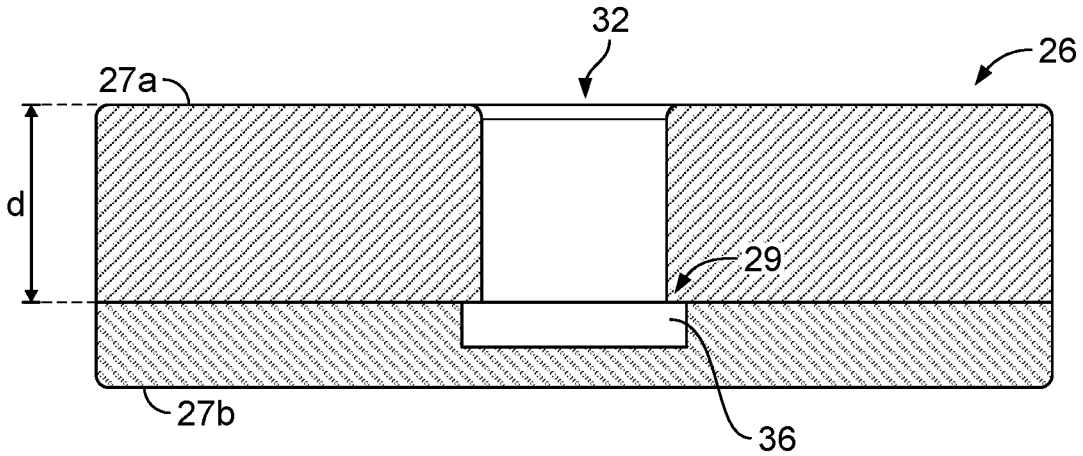
FIG. 4B is a cross-sectional view of the wheel of FIG. 4A.

When used in the cart configuration, as shown in FIGS. 3A and 3B, the activity box 2 includes a first wheel 26*a*, a second wheel 26*b*, a third wheel 26*c*, a fourth wheel 26*d*, a first axle 24*a*, and a second axle 24*b*. FIG. 4A shows a perspective view of a wheel 26 having a first surface 27*a* that further defines blind hole 32. FIG. 4B shows a cross-sectional view of wheel 26 on line 34 of FIG. 4A. Blind hole 32 has a depth d that starts at the first surface 27*a* but does not go through to the second surface 27*b*. Wheel 26 includes a first magnetically attractable component 36 that is embedded within the wheel 26 at a base 29 of blind hole 32. In some embodiments, the first magnetically attractable component 38 is a magnet or a component that is attracted to a magnet. In some examples, the first magnetically attractable component 36 is made from a ferromagnetic material.

Figure 5A:
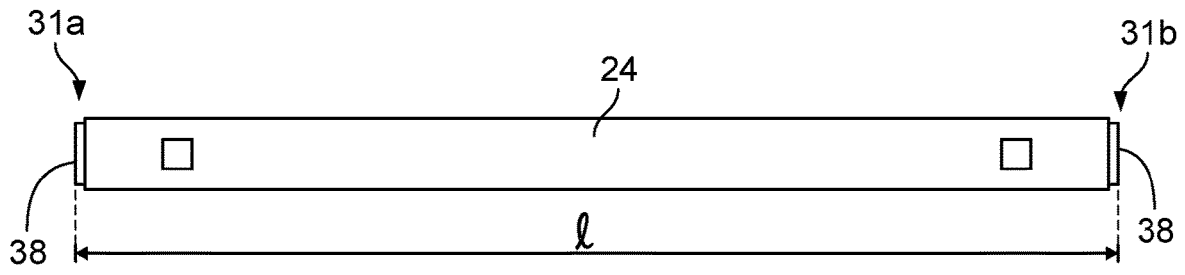
FIG. 5A is a side view of an axle.
Figure 5B:
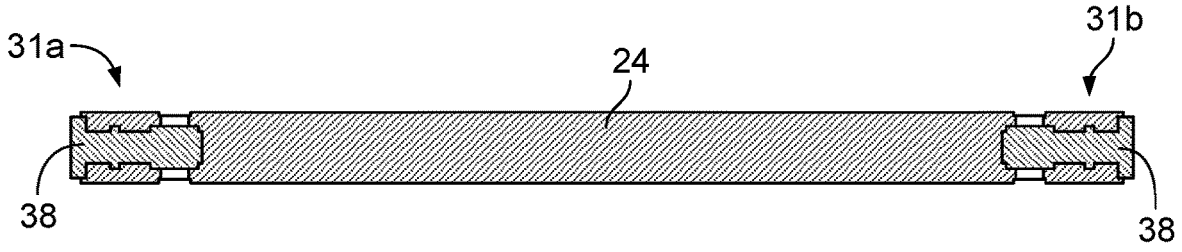
FIG. 5B is a side, cross-sectional view of the axle of FIG. 5A.

FIGS. 5A and 5B show an axle 24 having a pair of second magnetically attractable components 38 secured a first and second ends 31*a* and 31*b* of axle 24. In some embodiments, the second magnetically attractable component 38 is a magnet or a component that is attracted to a magnet. In some examples, the second magnetically attractable component 38 is made from a ferromagnetic material. In some embodiments, the second magnetically attractable component 38 is an overmolded insert. The overmolded insert can be a steel insert. Box 4 defines a space having a defined volume sufficiently large to fit the first and second axles 24*a* and 24*b*. First and second axles 24*a* and 24*b* have a length l spanning a width w of the box 4. Box 4 has two pairs of through holes (i.e., 8*a*, 8*b*, 8*c*, and 8*d*) on two opposing side walls 5 that accommodate the first and second axles 24*a* and 24*b*. The first and second axles 24*a* and 24*b* are thus threaded through the through holes 8*a*, 8*b*, 8*c*, and 8*d* when the activity box 2 is in the cart configuration. A user (e.g., a child 28) can releasably insert the first and second ends 31*a* and 31*b* of the first and second axles 24*a* and 24*b* into the blind holes 32 of the first, second, third, and fourth wheels 26*a*, 26*b*, 26*c*, and 26*d*, respectively. Next, the user (e.g., a child 28) can rotatably attach the two pairs of wheels 26 to the box 4 by magnetically coupling the first magnetically attractable component 36 to the second magnetically attractable component 38 secured at each end 31*a* and 31*b* of each axle 24. Thus, the axles 24 and wheels 26 are physically and mechanically engaged during assembly of the cart configuration. Alternatively, in some embodiments, the axles can releasably couple to the wheels via a snap-in or click-in couplings.

Figure 6A:
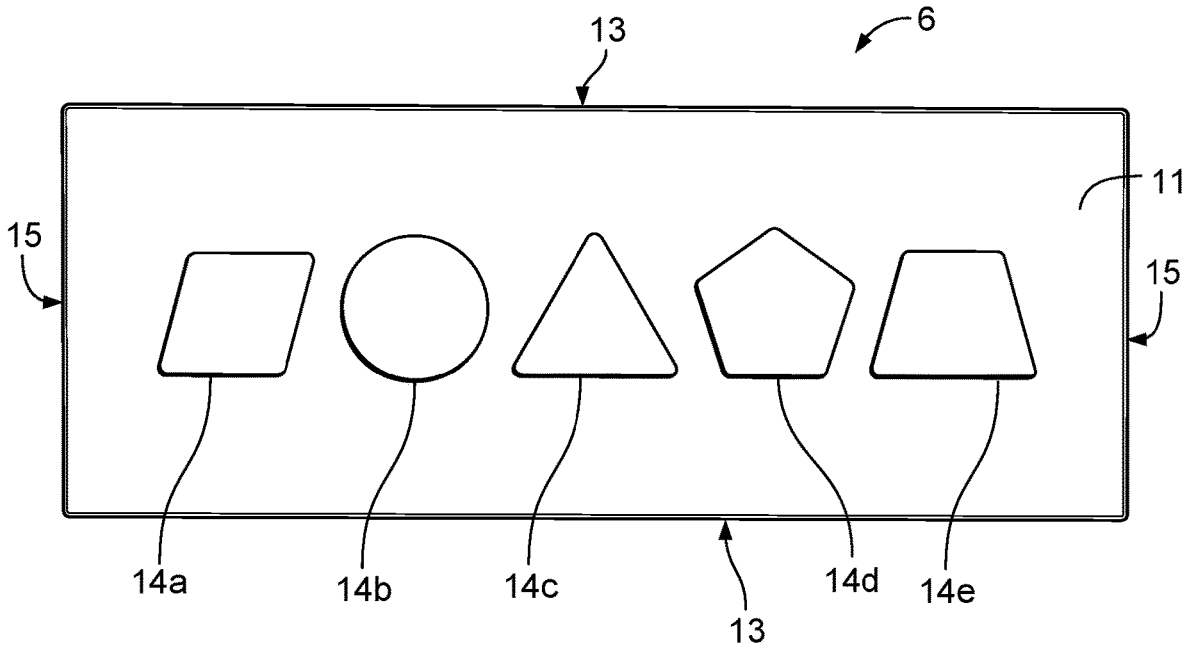
FIG. 6A is a top view of a lid.
Figure 6B:
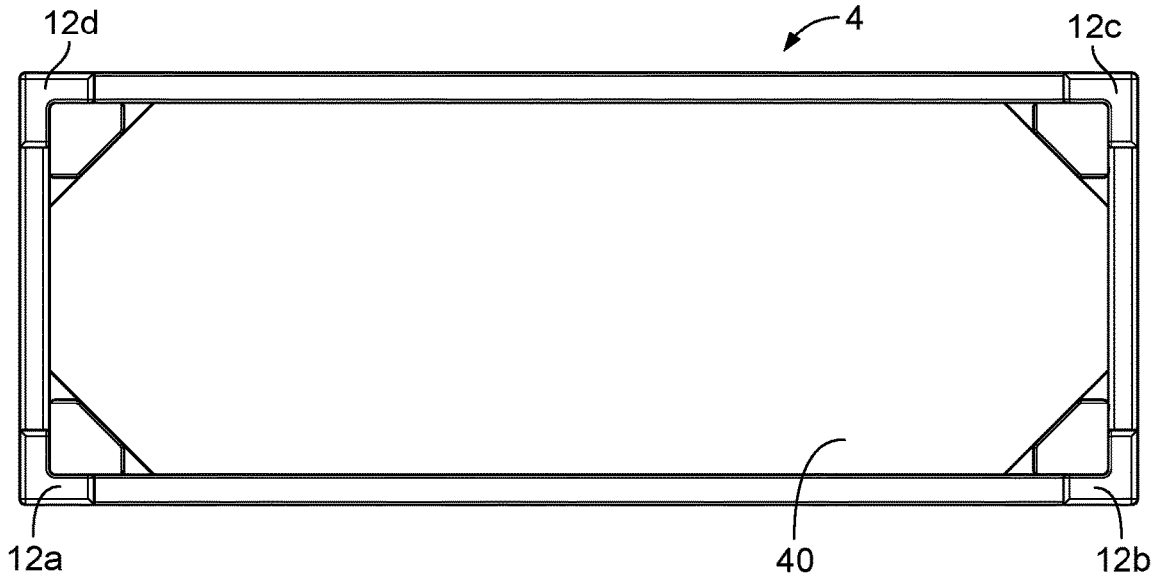
FIG. 6B is a bottom view of a box including corner protectors.
Figure 6C:
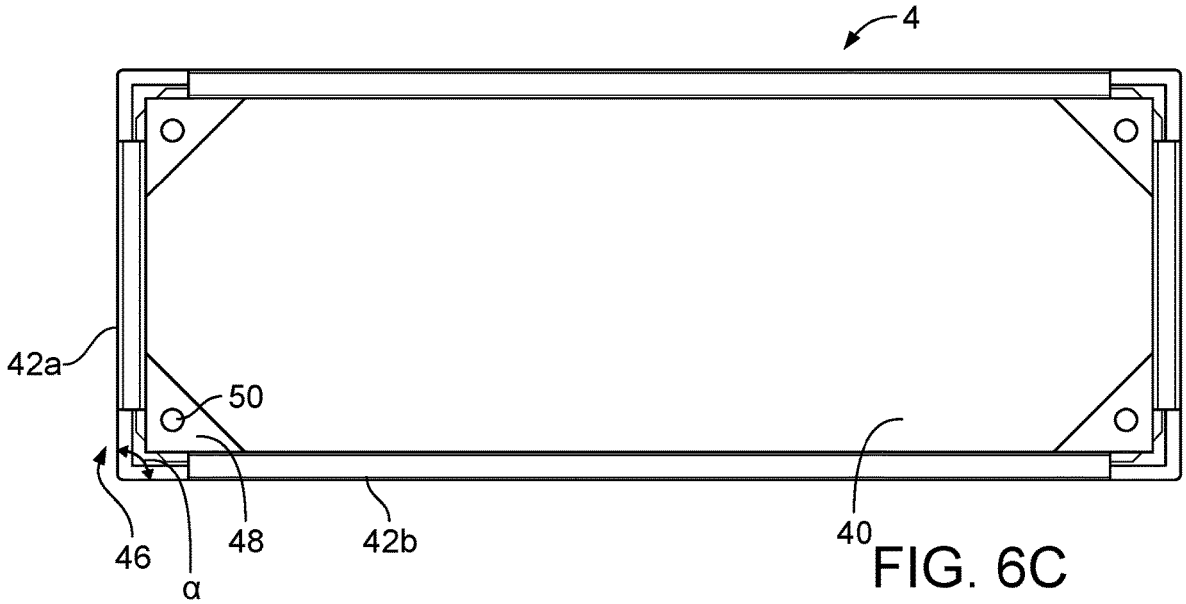
FIG. 6C is a bottom view of the box excluding corner protectors.

FIG. 6A shows a top view of the top side 11 of lid 6. Lid 6 has five different apertures (i.e., 14*a*, 14*b*, 14*c*, 14*d*, and 14*e*), each aperture shaped to fit a component therethrough, as described above. FIG. 6B shows a bottom view of box 4 having a bottom surface 40 and corner protectors 12*a*, 12*b*, 12*c*, and 12*d* disposed at each corner. FIG. 6C shows a bottom view of box 4 excluding corner protectors 12*a*, 12*b*, 12*c*, and 12*d*. As can be seen in FIG. 6*c*, box 4 has two adjacent sides 42*a* and 42*b* forming a right angle α at a corner recess 46. Corner recess 46 is configured to receive a corner protector 12. Box 4 further includes a wooden brace 48 that is attached to the two adjacent sides 42*a* and 42*b* at the corner recess 46. The wooden brace 48 defines a hole 50. The wooden brace 48 provides support to a load, strengthens right angle α, or both provides support to a load and strengthens right angle α.

Figure 7A:
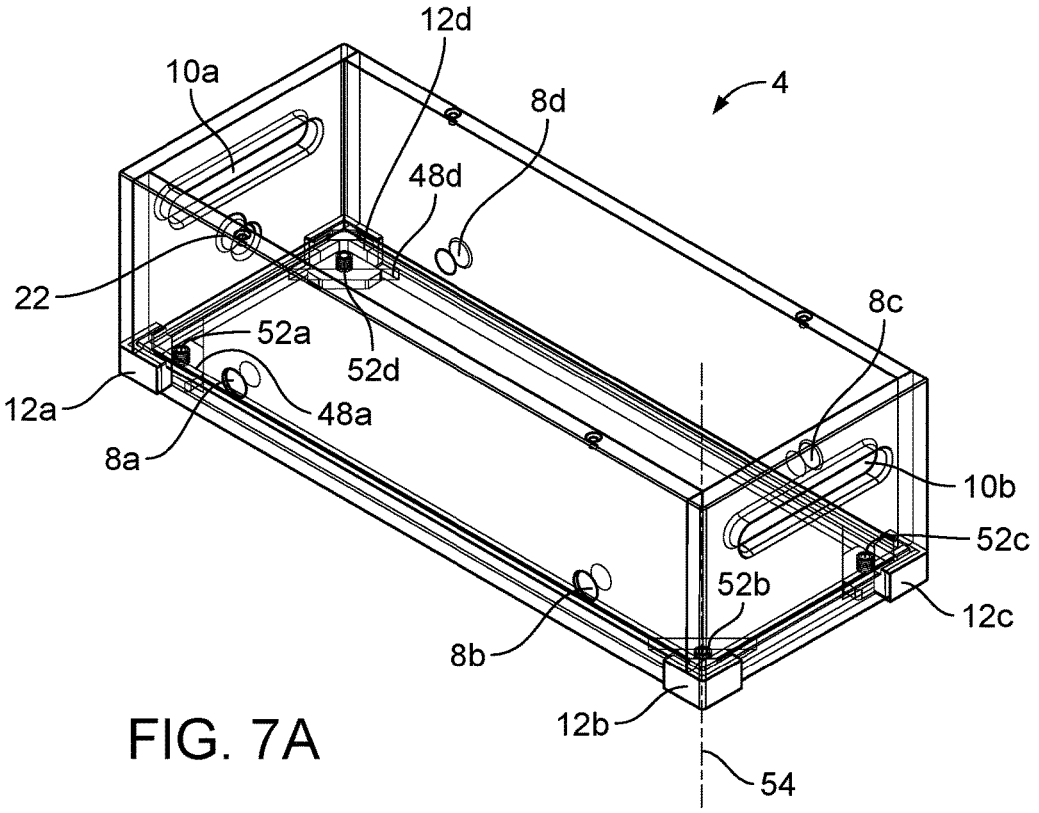
FIG. 7A is a perspective view of the box.
Figure 7B:
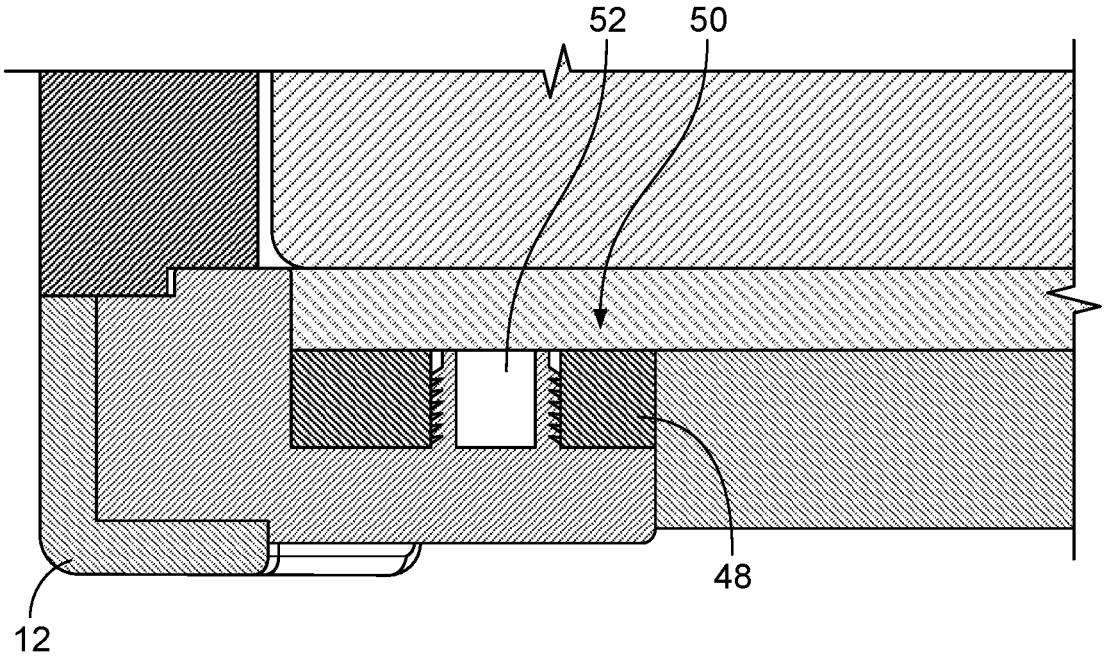
FIG. 7B is a cross-sectional view of a corner of the box.

FIG. 7A shows a perspective, partially transparent view of box 4 including the corner protectors 12*a*, 12*b*, 12*c*, and 12*d*. Corner protectors 12*a*, 12*b*, 12*c*, and 12*d* are designed to non-releasably couple to an outer surface of each corner of box 4. FIG. 7B shows a cross-section view on line 54 of FIG. 7A. As is shown in FIG. 7B, a threaded rod 52 of corner protector 12 is non-releasably inserted (e.g., glued) into hole 50. Thus, hole 50 is configured to receive the threaded rod 52.

Figure 8:
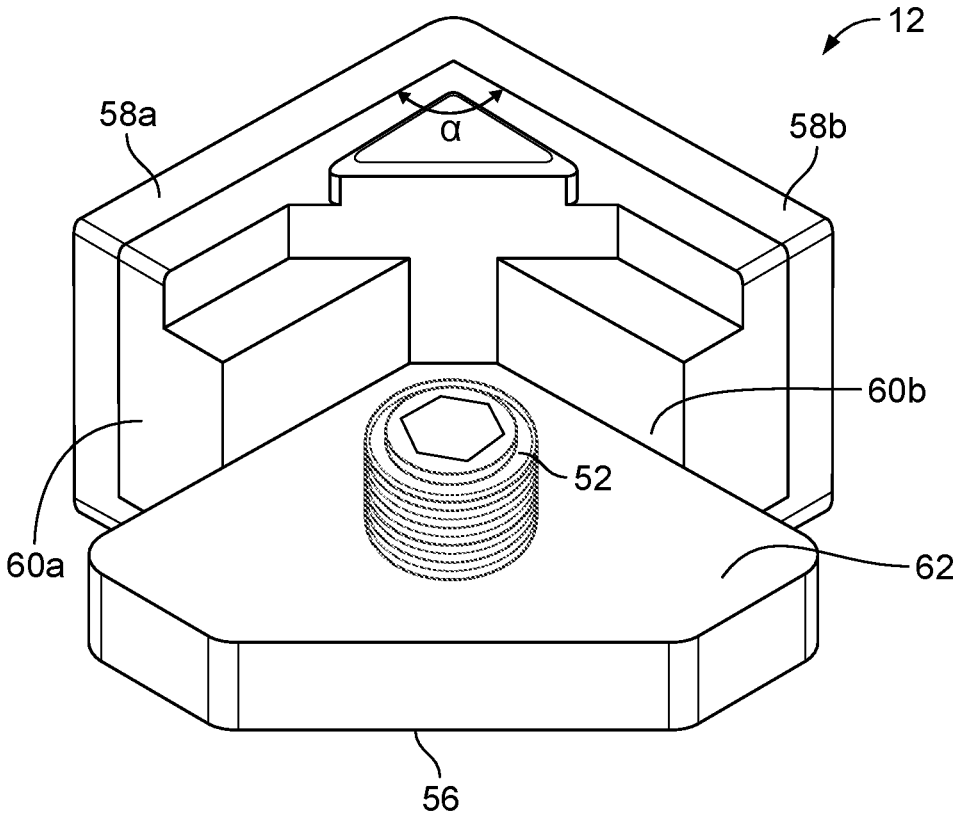
FIG. 8 is a perspective view of a corner protector.

Referring to FIG. 8, corner protector 12 has a rigid plastic core having a first wall 58*a* and a second wall 58*b* that integrally connected and form a first right angle α therebetween. The rigid plastic core can be made out of nylon, polyamide, or any other suitable materials. Corner protector 12 further includes a plate 56 extending perpendicularly from first and second interior surfaces 60*a* and 60*b* of the first and second walls 58*a* and 58*b*. The plate 56 has the threaded rod 52 extending from a top surface 62 of the plate 56. Corner protector 12 further includes a shock-absorbing exterior surface molded over the rigid plastic core. The shock-absorbing exterior surface provides impact resistance for the activity box 2. Thus, the corner protector 12 enables activity box 2 to be capable of withstanding foreseeable use, damage, or abuse by children, such as impact of the activity box 2 onto an impact medium (e.g., a ground surface). In some embodiments, the shock-absorbing exterior surface is made out of a flexible or pliable material. Non-limiting examples of flexible or pliable materials include rubber, silicone, and polyurethane. In some embodiments, the rubber material can be a thermoplastic rubber. In some embodiments, the shock-absorbing exterior surface is made from a material including, but not limited to, a thermoplastic polyurethane, thermoplastic rubber, and thermoplastic elastomer.

Figure 9:
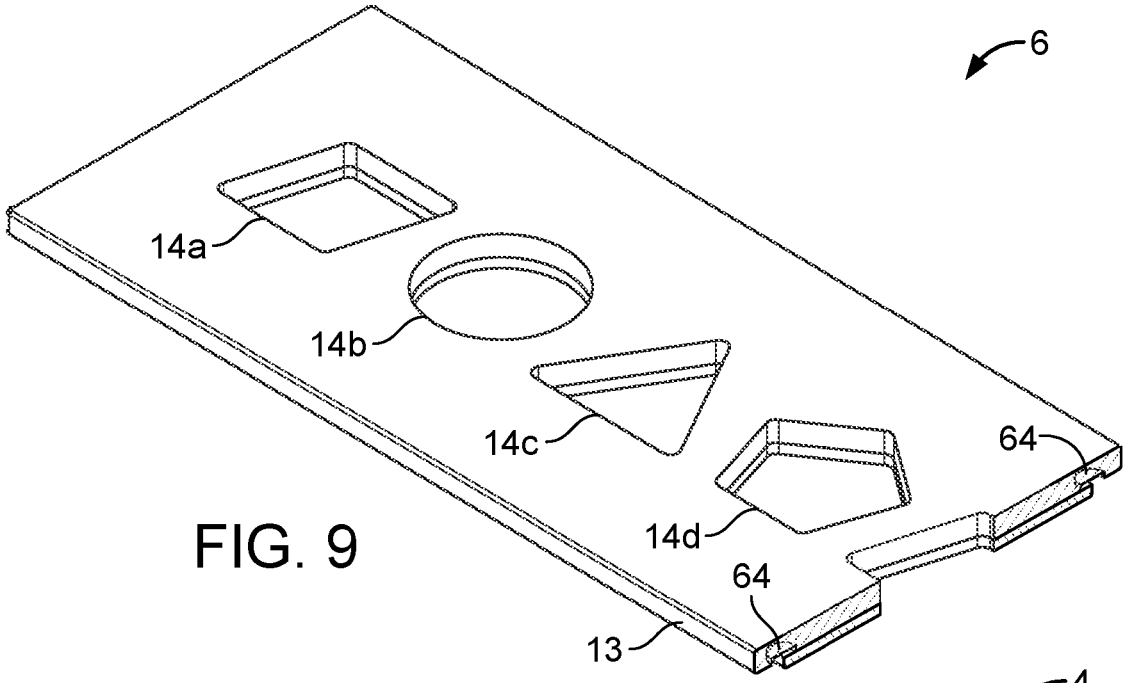
FIG. 9 is a cross-sectional view of the lid.
Figure 10A:
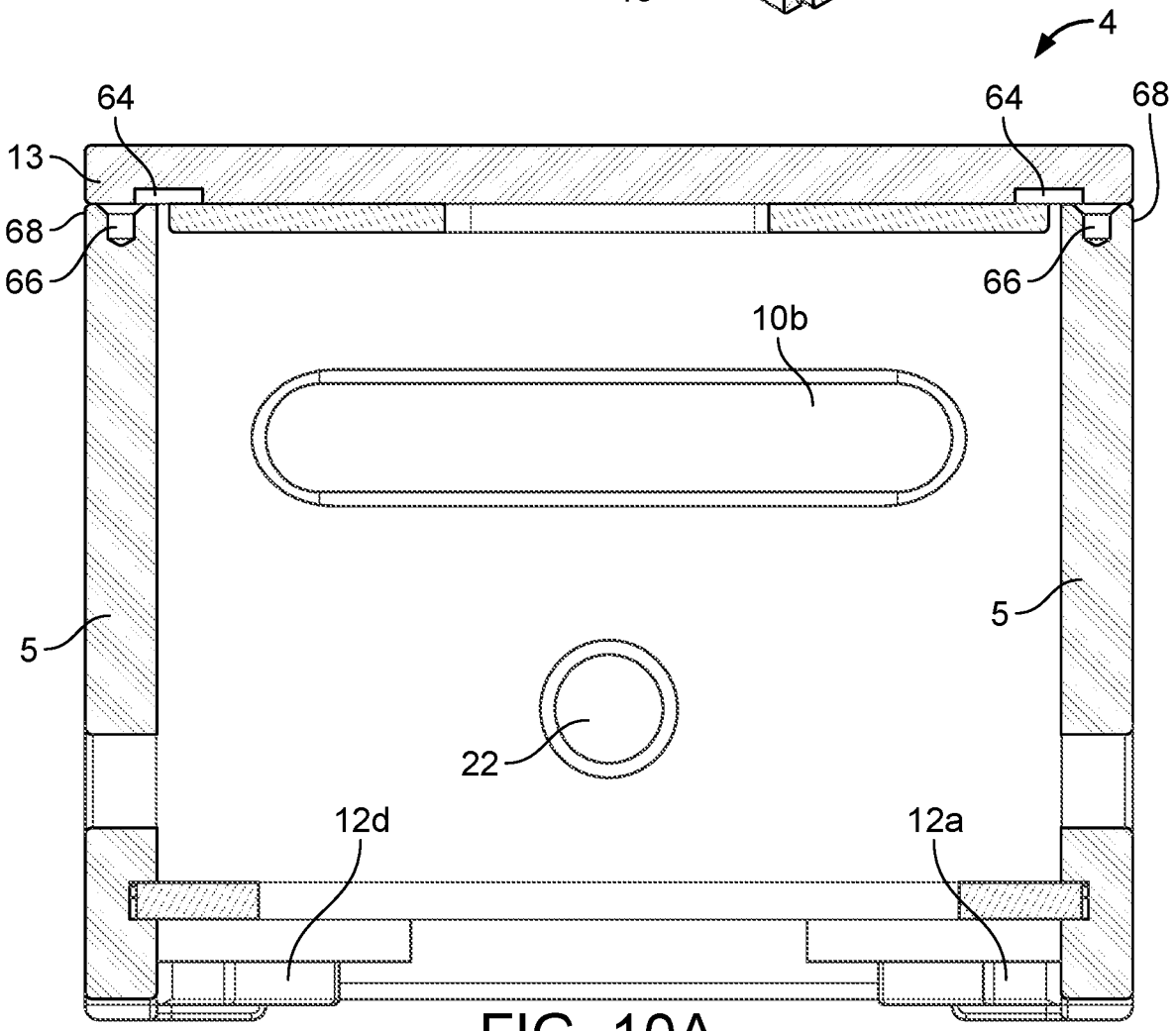
FIG. 10A is a side view of the box.
Figure 10B:
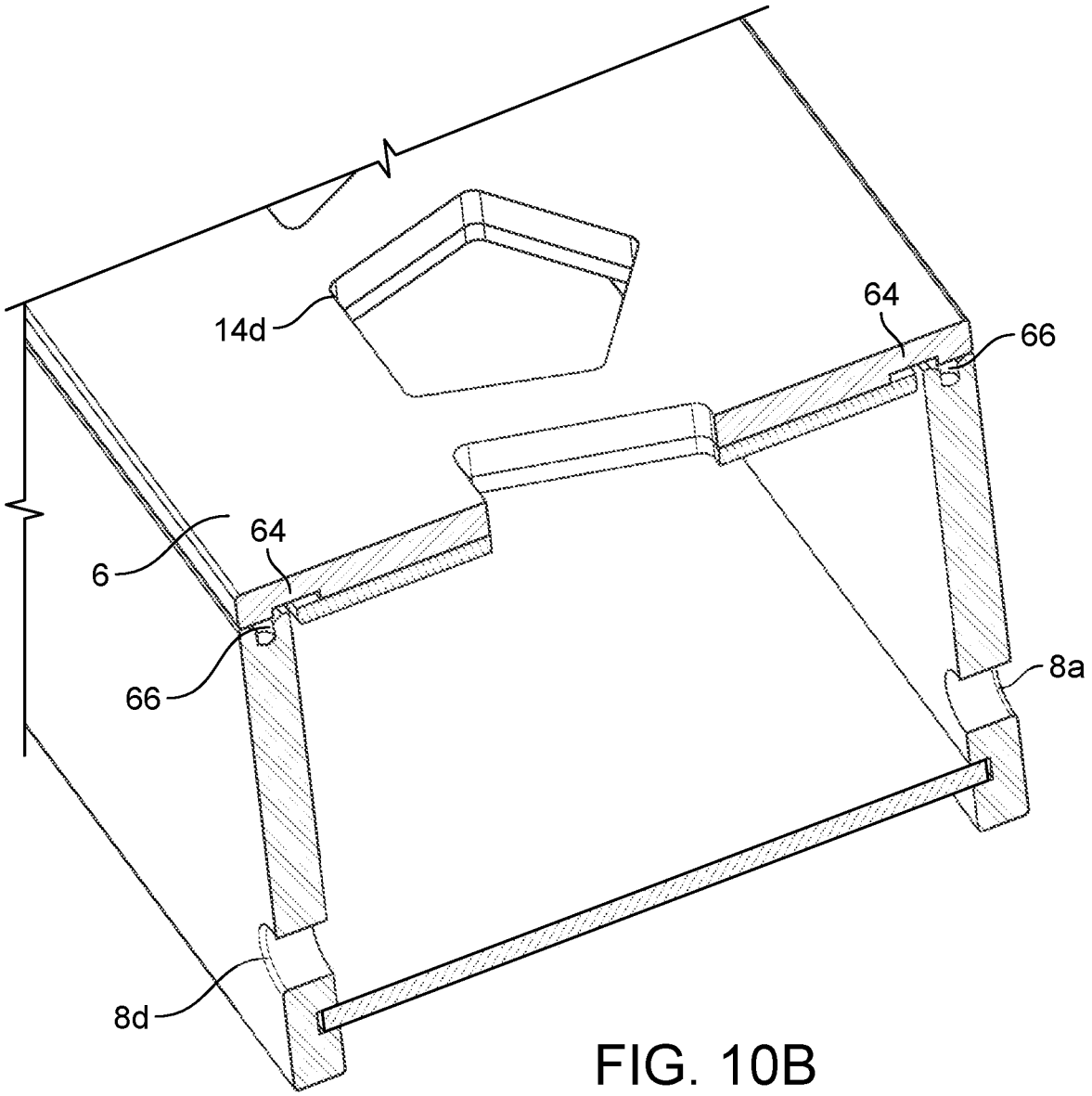
FIG. 10B is a cross-sectional view of the activity box.

Referring to FIG. 9, lid 6 is a magnetic lid having side edges 13 with first magnetic elements 64 embedded therein. Lid 6 can be a magnetic lid having rims or edges with more than one magnetic elements embedded therein. In this example, lid 6 has four magnetic elements 64 embedded within the side edges 13. Box 4 further includes four magnetic elements 66, as shown in FIG. 10A, which is a cross-sectional view of box 4. Magnetic elements 66 are embedded within the top edges 68 of side walls 5. Magnetic elements 64 and 66 are positioned such that they are partially or completely aligned in order to facilitate magnetic coupling of the lid 6 and box 4 when lid 6 is placed on top of box 4. In the example shown in FIG. 10B, the magnetic elements 64 and 66 are aligned with through holes 8*a* and 8*d*. In some embodiments, the magnetic elements 64 and 66 can be positioned in any suitable portion of any edge of lid 6 and box 4, respectively. In some embodiments, the magnetic elements 64 and 66 are magnets or components that are attracted to a magnet. In some examples, the magnetic elements 64 and 66 are made from a ferromagnetic material. In some embodiments, the magnetic elements 66 are ferromagnetic screws or magnetic screws. In some embodiments, magnetic elements 64 are semicircular or circular magnets.

In play, the activity box 2 can be used in different configurations and with different activities that range in complexity and suitability for a variety of children ages. For example, activity box 2 can be used as a shape sorter box by placing the lid 6 on top of the box 4. The user (e.g., a child) can then match the shape of the shape sorter blocks 86 to the shape of the apertures 14*a*, 14*b*, 14*c*, 14*d*, and 14*e* and then drop the shape sorter blocks 86 through the apertures. In another example, the activity box 2 can be used by a user (e.g., a child) to "play pretend" using the figurines 84 and building house-like structures with the remaining components of the activity box 2. In another example, in play, the user (e.g., a child) can use the plurality of components 16*a* and 16*b* to build upward structures (e.g., towers). In some embodiments, the removable panel 18 can be made of a material that is optically transparent (e.g., a clear plastic). In yet another example, in play, the user (e.g., a child) can sort the plurality of components 16*a* and 16*b* by, for example, color or shape.

In another example, in play, the user (e.g., a child) can use the plurality of components 16*a* and 16*b* to make patterns (e.g., positioning one type of component next to a different type of component and repeating this structure sequentially). In another example, in play, the user (e.g., a child) can use the plurality of components 16*a* and 16*b* to make a domino trail using the building planks 72. In another example, in play, the user (e.g., a child) can arrange the plurality of components 16*a* and 16*b* into shapes that resemble letters of the alphabet. In another example, in play, the user (e.g., a child) can magnetically couple wheels 26 and use the removable panel 18 as a ramp to roll the wheels 26 on. In another example, in play, the user (e.g., a child) can use the dowels 90 as "drumsticks" to bang on the bottom surface 40 of box 4. As previously described, in play, the user (e.g., a child) can use the activity box 2 in the cart configuration where the plurality of components 16*a* and 16*b* can be loaded into the space defined by box 4.

In another example, in play, the user (e.g., a child) can thread the threader string 88 through threading beads 80 and create patterns. Threading encourages hand-eye coordination and using both hands together. In another example, in play, the user (e.g., a child) can use the plurality of components 16*a* and 16*b* to build house-like structures by using the empty space defined by box 4 as an "empty room." In another example, in play, the user (e.g., a child) can use the plurality of components 16*a* and 16*b* to build or create faces and expressions. Building faces with the plurality of components 16*a* and 16*b* can help a child become more aware of her or his feelings, which is an early step in developing self-regulation. In another example, in play, the user (e.g., a child) can use the plurality of components 16*a* and 16*b* to build more elaborate, three-dimensional structures (e.g., tower-like, bridge-like, or city-like structures).

In another example, in play, the user (e.g., a child) can use the plurality of components 16*a* and 16*b* to practice jumping over small hurdles (e.g., by placing a dowel end of the threading string 88 into a first wheel 26*a* and placing a toggle end of the threading string 88 into a second wheel 26*b*). In another example, in play, the user (e.g., a child) can use the plurality of components 16*a* and 16*b* to make paths for figurines 84 by lining up the building planks 72 on a surface. By lining up objects and creating paths, a child can develop spatial relationships (e.g., by learning that multiples of one object can connect and build something larger on a flat plane). In another example, in play, the user (e.g., a child) can use the plurality of components 16*a* and 16*b* to learn how to count (e.g., by building towers with one or more building blocks 70). In yet another example, in play, the user (e.g., a child) can use the plurality of components 16*a* and 16*b* to build tower-like structures. In yet another example, in play, the user (e.g., a child) can use markers to draw or write on a removable panel made from a clear plastic material.

While a number of examples have been described for illustration purposes, the foregoing description is not intended to limit the scope of the invention, which is defined by the scope of the appended claims. There are and will be other examples and modifications within the scope of the following claims.

What is claimed is:

1. An activity box, comprising:

a box having a bottom surface, a pair of opposing side walls, and a pair of opposing end walls, the pair of opposing side and end walls extending upwardly from the bottom surface and defining an interior space, the box comprising:

a corner protector comprising:

a rigid plastic core having a pair of walls integrally connected and forming a first right angle therebetween;

a plate extending perpendicularly from an interior surface of the pair of walls, the plate having a threaded rod extending from a top surface of the plate; and a shock-absorbing exterior surface molded over the rigid plastic core, the shock-absorbing exterior surface configured to provide impact resistance for the box, wherein a side wall and an end wall of the box form a second right angle at a corner recess configured to receive the corner protector; and a wooden brace attaching to the side and end walls at the corner recess, the wooden brace defining a hole configured to receive the threaded rod.

2. The activity box of claim 1, wherein the shock-absorbing exterior surface is made out of a flexible material.

3. The activity box of claim 2, wherein the flexible material is rubber, silicone, or polyurethane.

4. The activity box of claim 1, wherein the wooden brace is configured to provide support to a load of the box or the second right angle.

5. The activity box of claim 1, wherein the corner protector is configured to non-reversibly couple to the corner recess.

6. The activity box of claim 1, wherein an edge of the plate is aligned with an edge of the wooden brace.

7. The activity box of claim 1, wherein a bottom surface of the plate is offset from a bottom surface of the pair of walls.

8. The activity box of claim 7, wherein a top surface of the plate is configured to contact a surface of the wooden brace.

9. The activity box of claim 8, wherein the corner recess is configured to receive the pair of walls of the corner protector.

10. The activity box of claim 1, wherein the wooden brace is coupled to a bottom surface of the activity box.

11. The activity box of claim 1, wherein an outer surface of the pair of walls is flush with an outer surface of the side and end walls.

12. The activity box of claim 11, wherein a bottom surface of the pair of walls is flush with a bottom surface of the side and end walls.

13. The activity box of claim 1, wherein the plate is integrally connected to the pair of walls.

14. An activity box, comprising:

a box having a bottom surface, a pair of opposing side walls, and a pair of opposing end walls, the pair of opposing side and end walls extending upwardly from the bottom surface and defining an interior space, the box comprising:

a corner protector comprising:

a rigid plastic core having a pair of walls integrally connected and forming a first right angle therebetween;

a plate extending perpendicularly from an interior surface of the pair of walls, the plate having a threaded rod extending from a top surface of the plate; and a shock-absorbing exterior surface molded over the rigid plastic core, the shock-absorbing exterior surface configured to provide impact resistance for the box, wherein a side wall and an end wall of the box form a second right angle at a corner recess configured to receive the corner protector; and a wooden brace attaching to the side and end walls at the corner recess, the wooden brace defining a hole configured to receive the threaded rod; and a lid comprising a first magnetic element embedded within a thickness of the lid and proximate to an edge of the lid, wherein the first magnetic element is configured to align with and magnetically couple to a second magnetic element embedded within the side wall and proximate to an edge of the box, when the lid covers the box.

15. The activity box of claim 14, wherein the pair of opposing side walls defines a pair of through holes.

16. The activity box of claim 15, wherein a top surface of the plate is configured to contact a surface of the wooden brace.

17. The activity box of claim 16, wherein the corner recess is configured to receive the pair of walls of the corner protector.

18. The activity box of claim 17, wherein an edge of the plate is aligned with an edge of the wooden brace.

19. The activity box of claim 18, wherein a bottom surface of the pair of walls is flush with a bottom surface of the side and end walls.

20. The activity box of claim 19, wherein the wooden brace is coupled to a bottom surface of the activity box.

* * * * *